US011021341B2

(12) United States Patent
Kishimoto

(10) Patent No.: US 11,021,341 B2
(45) Date of Patent: Jun. 1, 2021

(54) SHEET ALIGNING DEVICE, SHEET PROCESSING DEVICE, IMAGE PROCESSING APPARATUS

(71) Applicant: KYOCERA Document Solutions Inc., Osaka (JP)

(72) Inventor: Tadahisa Kishimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 196 days.

(21) Appl. No.: 16/452,995

(22) Filed: Jun. 26, 2019

(65) Prior Publication Data

US 2020/0017325 A1 Jan. 16, 2020

(30) Foreign Application Priority Data

Jul. 10, 2018 (JP) ..... JP2018-130484

(51) Int. Cl.
*B65H 31/26* (2006.01)
*B65H 7/02* (2006.01)
(Continued)

(52) U.S. Cl.
CPC ..... *B65H 31/26* (2013.01); *B65H 7/02* (2013.01); *B65H 9/04* (2013.01); *B65H 9/08* (2013.01); *B65H 9/101* (2013.01); *B65H 29/16* (2013.01); *B65H 31/20* (2013.01); *B65H 31/36* (2013.01); *B65H 37/04* (2013.01); *B65H 37/06* (2013.01); *B41J 11/0045* (2013.01); *B41J 11/42* (2013.01);
(Continued)

(58) Field of Classification Search
CPC . B65H 7/20; B65H 9/004; B65H 9/04; B65H 9/06; B65H 9/08; B65H 9/101; B65H 31/04; B65H 31/08; B65H 31/10; B65H 31/20; B65H 31/26; B65H 31/34; B65H 31/36; B65H 2405/11152; B65H 2405/1122; B65H 2405/1134; B65H 2511/11; B65H 2801/27
See application file for complete search history.

(56) References Cited

U.S. PATENT DOCUMENTS 4,826,383 A * 5/1989 Millen ..... B65H 29/12 198/624
5,014,977 A * 5/1991 Moore ..... B65H 31/36 271/221

(Continued)

FOREIGN PATENT DOCUMENTS

JP 2007076893 A 3/2007

*Primary Examiner* — Prasad V Gokhale
(74) *Attorney, Agent, or Firm* — Alleman Hall Creasman & Tuttle LLP

(57) ABSTRACT

A sheet aligning device includes a support member, a regulation member, a regulation member moving mechanism, and an alignment member. The support member supports leading ends of sheets. The regulation member is connected to the support member and is provided to face an inclined tray in such a way as to define a sheet entry space in which the leading ends of the sheets enter. The regulation member moving mechanism is configured to, each time a sheet is conveyed onto the inclined tray, move the regulation member in a separating direction to widen the sheet entry space, and then in an approaching direction to narrow the sheet entry space. The alignment member aligns the sheets by abutting on rear ends of the sheets.

9 Claims, 6 Drawing Sheets

(51) Int. Cl.

| | |
|---|---|
| ***B65H 37/06*** | (2006.01) |
| ***B65H 37/04*** | (2006.01) |
| ***B65H 29/16*** | (2006.01) |
| ***B65H 9/08*** | (2006.01) |
| ***B65H 9/10*** | (2006.01) |
| ***B65H 9/04*** | (2006.01) |
| ***B65H 31/20*** | (2006.01) |
| ***B65H 31/36*** | (2006.01) |
| *B41J 11/42* | (2006.01) |
| *B41J 11/00* | (2006.01) |

(52) U.S. Cl.
CPC ..... *B65H 2301/433* (2013.01); *B65H 2405/1122* (2013.01); *B65H 2405/1134* (2013.01); *B65H 2511/11* (2013.01)

(56) References Cited

U.S. PATENT DOCUMENTS 6,819,906 B1 * 11/2004 Herrmann ..... G03G 15/6541 270/58.11
2006/0097445 A1 * 5/2006 Fukatsu ..... B65H 31/34 271/220

* cited by examiner

SHEET ALIGNING DEVICE, SHEET PROCESSING DEVICE, IMAGE PROCESSING APPARATUS

INCORPORATION BY REFERENCE

This application is based upon and claims the benefit of priority from the corresponding Japanese Patent Application No. 2018-130484 filed on Jul. 10, 2018, the entire contents of which are incorporated herein by reference.

BACKGROUND

The present disclosure relates to a sheet aligning device, a sheet processing device including the sheet aligning device, and an image processing apparatus including the sheet processing device.

In general, a sheet processing device connected to an image forming apparatus includes a sheet aligning device and a sheet working device, wherein the sheet aligning device aligns a plurality of sheets, and the sheet working device applies working to the aligned plurality of sheets. The image forming apparatus and the sheet processing device connected thereto constitute an image processing apparatus.

The sheet working device is, for example, a sheet folding device that folds a plurality of sheets in two or three, or a staple device that applies a staple process to the plurality of sheets.

The sheet aligning device receives, by an inclined tray, a plurality of sheets with images formed thereon and aligns the leading and rear ends of the plurality of sheets on the inclined tray. The sheet aligning device includes a support member that supports the leading ends of the sheets as the sheets are sequentially conveyed onto the inclined tray.

For example, there is known a technology in which a stopper is provided as the support member, wherein the stopper has a recess in which the leading ends of the sheets enter on the inclined tray.

SUMMARY

A sheet aligning device according to an aspect of the present disclosure has an inclined tray held by a frame and aligns a plurality of sheets conveyed onto the inclined tray. The sheet aligning device includes a support member, a support member moving mechanism, a regulation member, a regulation member moving mechanism, and a control unit. The support member is projected on the inclined tray, supported so as to be movable on the inclined tray, and has a support surface that abuts on leading ends of the sheets that are sequentially conveyed onto the inclined tray. The support member supports, at a predetermined reference position, the leading ends of the sheets. The support member moving mechanism moves the support member along the inclined tray. The regulation member is projected from the support surface toward an upstream in a sheet entry direction in which the sheets enter onto the inclined tray, supported so as to be movable on the support surface in a separating direction from or an approaching direction to the inclined tray, and defining a sheet entry space in which the leading ends of the sheets enter. The regulation member moving mechanism moves the regulation member on the support surface. The control unit controls the support member moving mechanism and the regulation member moving mechanism. The control unit controls the regulation member moving mechanism each time a sheet is conveyed onto the inclined tray, to widen the sheet entry space by moving the regulation member in the separating direction from the inclined tray, and then to narrow the sheet entry space by moving the regulation member in the approaching direction to the inclined tray.

A sheet processing device according to another aspect of the present disclosure includes the sheet aligning device and a sheet working device. The sheet aligning device aligns a plurality of sheets with images formed thereon supplied from an image forming apparatus. The sheet working device applies a predetermined working to the plurality of sheets aligned by the sheet aligning device.

An image processing apparatus according to a further aspect of the present disclosure includes an image forming apparatus and the sheet processing device. The image forming apparatus forms an image on a sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment

A sheet processing device 1000 according to a first embodiment of the present disclosure performs predetermined sheet processing to sheets 9 supplied from an image forming apparatus 10. The sheets 9 are prints on which images have been formed. The sheets 9 are sheet-like image formation media such as sheets of paper or resin films.

The image forming apparatus 10 and the sheet processing device 1000 are included in an image processing apparatus 1. That is, the image processing apparatus 1 includes the image forming apparatus 10 and the sheet processing device 1000 connected to the image forming apparatus 10.

Figure 1:
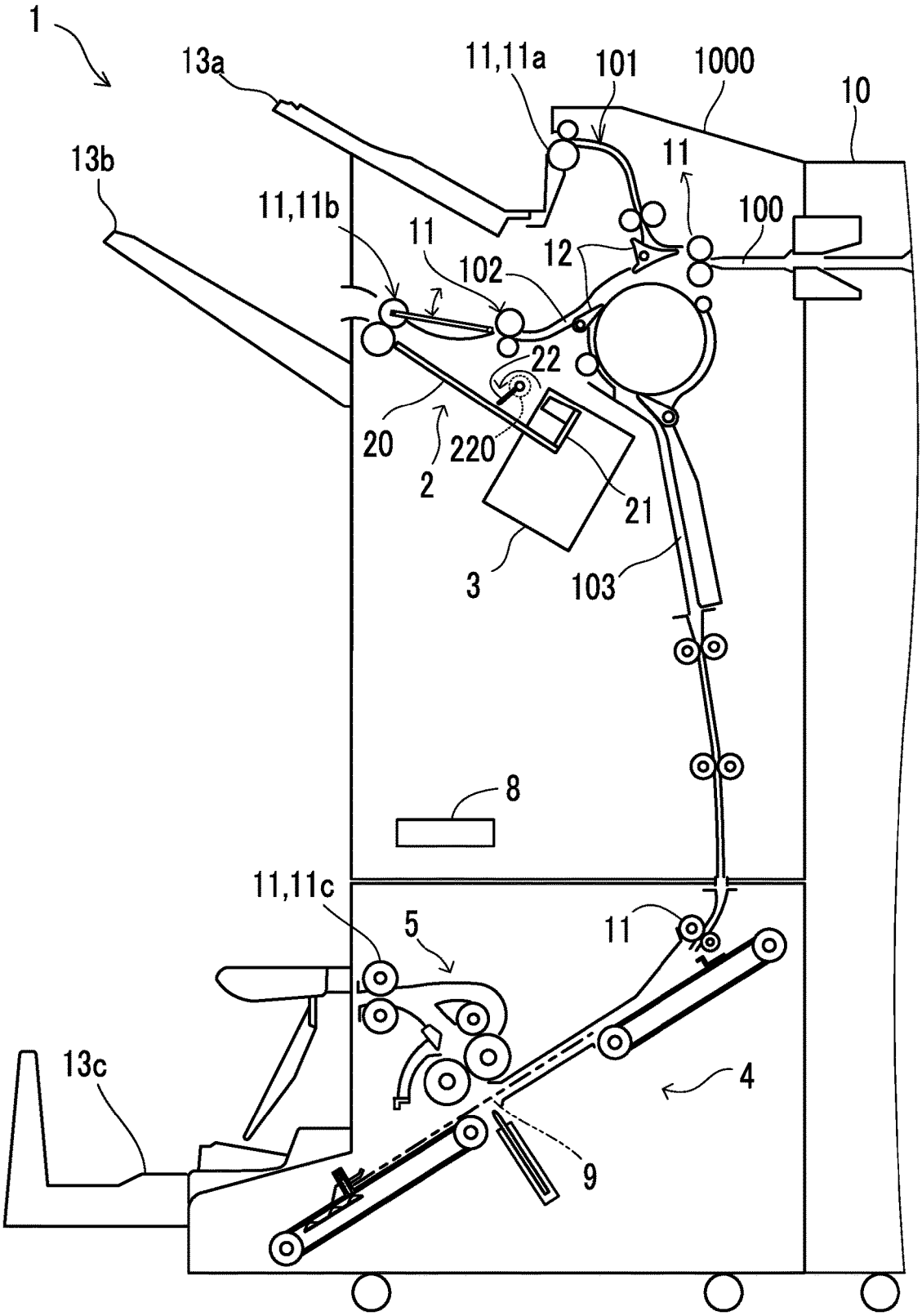
FIG. 1 is a configuration diagram of a sheet processing device according to a first embodiment of the present disclosure.

As shown in FIG. 1, the sheet processing device 1000 includes a plurality of pairs of conveyance rollers 11, a path switching mechanism 12, a first ejection tray 13*a*, a second ejection tray 13*b*, a third ejection tray 13*c*, a first sheet aligning device 2, a staple device 3, a second sheet aligning device 4, a sheet folding device 5, and a control unit 8.

The plurality of pairs of conveyance rollers 11 convey the sheets 9 with images formed thereon supplied from the image forming apparatus 10, along any of a plurality of sheet conveyance paths 100, 101, 102, and 103.

The plurality of sheet conveyance paths 100, 101, 102, and 103 are a main conveyance path 100, a first conveyance path 101, a second conveyance path 102, and a third conveyance path 103.

The path switching mechanism 12 guides the sheets 9 that have been supplied from the image forming apparatus 10 to the main conveyance path 100, selectively to any one of the first conveyance path 101, the second conveyance path 102, and the third conveyance path 103.

The plurality of pairs of conveyance rollers 11 include a first pair of ejection rollers 11*a*, a second pair of ejection rollers 11*b*, and a third pair of ejection rollers 11*c*.

The first pair of ejection rollers 11*a* eject the sheets 9 conveyed along the first conveyance path 101, to the first ejection tray 13*a*. The second pair of ejection rollers 11*b* eject the sheets 9 conveyed along the second conveyance path 102 and processed by the first sheet aligning device 2, to the second ejection tray 13*b*. The third pair of ejection rollers 11*c* eject the sheets 9 conveyed along the third conveyance path 103 and processed by the second sheet aligning device 4 and the sheet folding device 5, to the third ejection tray 13*c*.

The first sheet aligning device 2 includes a first inclined tray 20, a first support member 21, an alignment rotator 22, and a motor 220 configured to drive the alignment rotator 22. The first inclined tray 20 is formed to be inclined with respect to the horizontal direction and receive a plurality of sheets 9 sequentially conveyed from diagonally above. The first sheet aligning device 2 aligns a plurality of sheets 9 conveyed from the second conveyance path 102 onto the first inclined tray 20.

The first support member 21 is disposed at a lower portion of the first inclined tray 20, and supports the leading ends of the sheets 9 that are sequentially conveyed onto the first inclined tray 20. The alignment rotator 22 is a rubber member that is rotationally driven at a position facing the first inclined tray 20.

The alignment rotator 22, while rotating, contacts the upper surface of the sheets 9 on the first inclined tray 20. The alignment rotator 22 applies, to the sheets 9 on the first inclined tray 20, a diagonally downward force, namely a force that biases the sheets 9 toward the first support member 21.

The first sheet aligning device 2 aligns leading ends 9*a* of the plurality of sheets 9 on the first inclined tray 20 to a surface of the first support member 21. It is noted that the alignment rotator 22 and the motor 220 configured to drive the alignment rotator 22 are an example of a sheet biasing mechanism.

The staple device 3 performs staple processing to a portion of the plurality of sheets 9 on the first inclined tray 20 aligned by the first sheet aligning device 2, the portion being close to the leading ends 9*a* of the sheets 9. The staple device 3 is an example of a sheet working device for applying stapling to the sheets 9. It is noted that the staple processing may not be performed to the sheets 9 by the staple device 3.

The second pair of ejection rollers 11*b* eject the plurality of sheets 9 on the first inclined tray 20 that have been aligned in an overlaid state, to the second ejection tray 13*b* in one batch.

Figure 3:
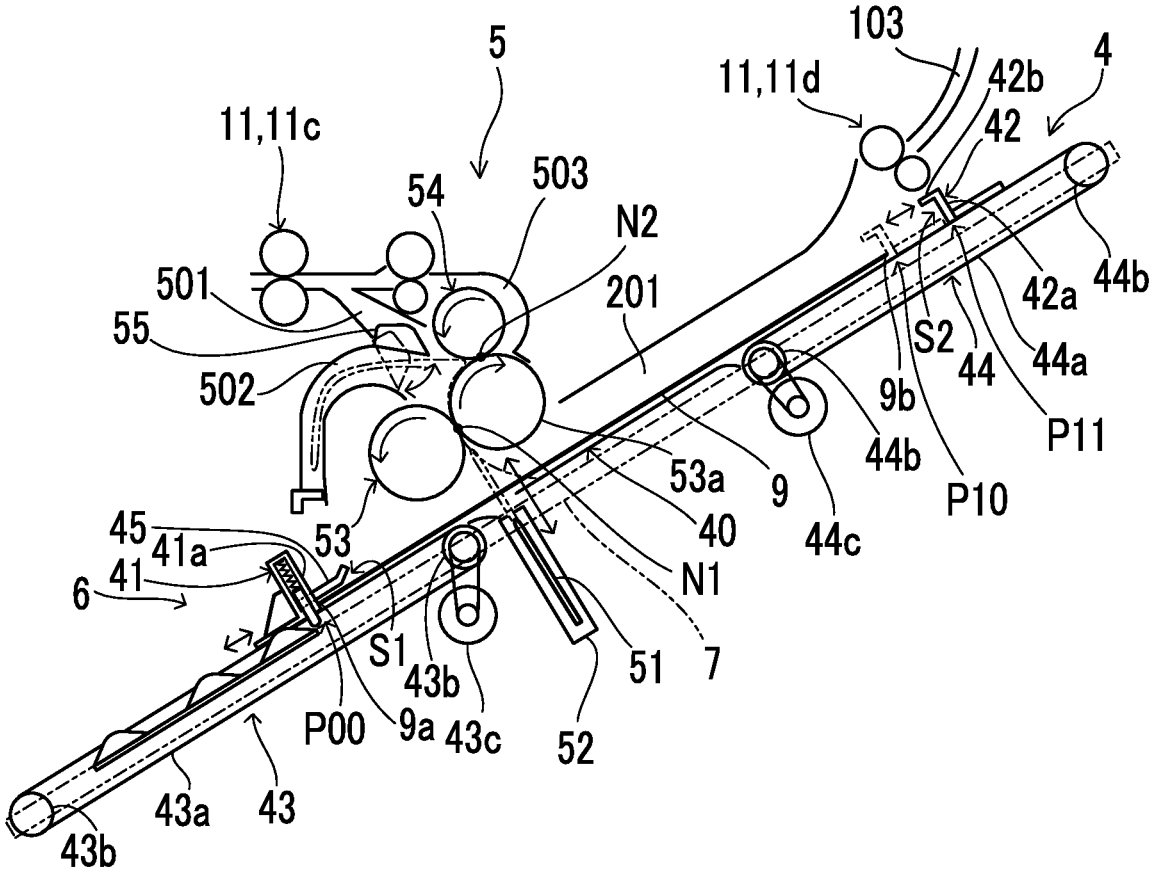
FIG. 3 is a configuration diagram of a second sheet aligning device and a sheet folding device included in the sheet processing device according to the first embodiment.

As shown in FIG. 3, the second sheet aligning device 4 includes a second inclined tray 40, a second support member 41, an upper alignment member 42, a support member moving mechanism 43, and an upper alignment member moving mechanism 44. The control unit 8 controls the support member moving mechanism 43 and the upper alignment member moving mechanism 44. The second sheet aligning device 4 is an example of a sheet aligning device, the second inclined tray 40 is an example of an inclined tray, and the second support member 41 is an example of a support member.

The second sheet aligning device 4 aligns a plurality of sheets 9 conveyed from the third conveyance path 103 onto the second inclined tray 40. The second inclined tray 40 is formed to be inclined with respect to the horizontal direction and receive a plurality of sheets 9 sequentially conveyed from diagonally above. The second inclined tray 40 is held by a frame 7 of the sheet processing device 1000 at a predetermined position (see FIG. 3). The frame 7 is a supporting body fixed within the sheet processing device 1000.

The second support member 41 is projected on the second inclined tray 40. The second support member 41 is supported so as to be movable on the second inclined tray 40. The second support member 41 supports the leading ends 9*a* of the sheets 9 that are sequentially conveyed onto the second inclined tray 40 by the plurality of pairs of conveyance rollers 11. The second support member 41 includes a support surface 41*a* that abuts on leading ends of the sheets 9. The upper alignment member 42 is provided to face the second support member 41 at an interval on the second inclined tray 40, the upper alignment member 42 being diagonally above the second support member 41.

For example, the second support member 41 and the upper alignment member 42 are provided at the center of the second inclined tray 40 in the width direction thereof. The width direction is perpendicular to a direction in which the sheets 9 are conveyed onto the second inclined tray 40. In FIG. 1, FIG. 3 to FIG. 9, the width direction is a depth direction on the paper surfaces of the drawings.

The support member moving mechanism 43 moves the second support member 41 along the second inclined tray 40. The upper alignment member moving mechanism 44 causes the upper alignment member 42 to abut on rear ends 9*b* of the sheets 9 on the second inclined tray 40 by moving the upper alignment member 42 along the second inclined tray 40.

The upper alignment member moving mechanism 44 applies a diagonally downward force, namely a force that biases the sheets 9 toward the second support member 41, to the sheets 9 on the second inclined tray 40 by causing the upper alignment member 42 to abut on the rear ends 9*b* of the sheets 9 on the second inclined tray 40.

The second sheet aligning device 4 aligns the leading ends 9*a* of the plurality of sheets 9 on the first inclined tray 20 to a surface of the second support member 41.

As described above, the upper alignment member 42 is configured to be movable along the second inclined tray 40 so as to align the sheets 9 on the second inclined tray 40 by abutting on the rear ends 9*b* of the sheets 9 supported by the second support member 41. It is noted that the upper alignment member moving mechanism 44 is an example of the sheet biasing mechanism.

The sheet folding device 5 applies folding to a plurality of sheets 9 aligned by the second sheet aligning device 4. The sheet folding device 5 is an example of the sheet working device. In the present embodiment, the sheet folding device 5 can perform a two-fold working and a three-fold working.

In the two-fold working, the sheet folding device 5 folds the sheets 9 in two by making one fold at the center of the sheets 9.

The sheet folding device 5 includes a blade 51, a blade moving mechanism 52, a first pair of folding rollers 53, a second pair of folding rollers 54, and a path switching mechanism 55. It is noted that the first pair of folding rollers 53 and the second pair of folding rollers 54 share one share roller 53*a*. Thus the first pair of folding rollers 53 and the second pair of folding rollers 54 are composed of three rollers as a whole.

The blade 51 is a plate-like member configured to strongly push a part of the sheets 9 on the second inclined tray 40 toward a first nip N1 between the first pair of folding rollers 53. The blade moving mechanism 52 moves the blade 51 toward the first nip Ni in a direction crossing the second inclined tray 40.

The first pair of folding rollers 53 hold therebetween the part of the sheets 9 strongly pushed by the blade 51, and convey the sheets 9 to a subsequent stage while making a first fold on the sheets 9.

The path switching mechanism 55 selectively guides the sheets 9 folded in two and fed out from the first pair of folding rollers 53, to the first conveyance path 501 that is directed to the third pair of ejection rollers 11*c*, or to the second conveyance path 502 that comes to a dead end.

In a case where the path switching mechanism 55 guides the sheets 9 folded in two to the first conveyance path 501, the sheets 9 are ejected while folded in two onto the third ejection tray 13*c* by the third pair of ejection rollers 11*c*.

In a case where the path switching mechanism 55 guides the two-fold sheets 9 to the second conveyance path 502, a part of the sheets 9 close to their rear end is guided by the path switching mechanism 55 to a second nip N2 between the second pair of folding rollers 54.

The second pair of folding rollers 54 hold therebetween the part of the two-fold sheets 9 guided to the second nip N2, and convey the sheets 9 to the third conveyance path 503 while making a second fold on the sheets 9. This allows the sheets 9 folded in three to be conveyed to the third conveyance path 503 that is directed to the third pair of ejection rollers 11*c*, and ejected by the third pair of ejection rollers 11*c* onto the third ejection tray 13*c*.

In FIG. 3, the sheets 9 in the middle of the three-fold working are represented by an imaginary line (two-dot chain line). First, the first pair of folding rollers 53 hold therebetween the sheets 9 so that a fold is made on the sheets 9 at a position approximately one-third in length from the leading end 9*a* in a conveyance direction of the sheets 9. Furthermore, the first pair of folding rollers 53 continue to convey the sheets 9 to the second conveyance path 502 with the fold being at the head, even after the leading end reaches the dead end. This causes the sheets 9 to bend, and the bent portion of the sheets 9 is held between the second pair of folding rollers 54. The second pair of folding rollers 54 convey the sheets 9 to the third conveyance path 503 while making another fold to the portion held therebetween.

The support member moving mechanism 43 includes an endless first belt 43*a*, a pair of first support rollers 43*b*, and a first motor 43*c*. The pair of first support rollers 43*b* support the first belt 43*a* such that the first belt 43*a* can move rotationally in the inclination direction of the second inclined tray 40.

The second support member 41 is fixed to the first belt 43*a*. A part of the first belt 43*a* supported by the pair of first support rollers 43*b* serves as a lower part of the second inclined tray 40.

The first motor 43*c* rotationally drives one of the pair of first support rollers 43*b*. The first motor 43*c* rotationally drives, via the pair of first support rollers 43*b*, the first belt 43*a* in a predetermined forward rotation direction or a reverse rotation direction. This allows the second support member 41 to move along the second inclined tray 40 at the lower part of the second inclined tray 40.

The upper alignment member moving mechanism 44 includes an endless second belt 44*a*, a pair of second support rollers 44*b*, and a second motor 44*c*. The pair of second support rollers 44*b* support the second belt 44*a* such that the second belt 44*a* can move rotationally in the inclination direction of the second inclined tray 40. The second inclined tray 40, the first belt 43*a*, and the second belt 44*a* form an inclined sheet placement surface on which the sheets 9 are placed.

The upper alignment member 42 is fixed to the second belt 44*a*. A part of the second belt 44*a* supported by the pair of second support rollers 44*b* serves as an upper part of the second inclined tray 40.

The second motor 44*c* rotationally drives one of the pair of second support rollers 44*b*. The second motor 44*c* rotationally drives, via the pair of second support rollers 44*b*, the second belt 44*a* in a predetermined forward rotation direction or a reverse rotation direction. This allows the upper alignment member 42 to move along the second inclined tray 40 at the upper part of the second inclined tray 40.

The upper alignment member 42 includes a base portion 42*a* and a regulation portion 42*b*. The base portion 42*a* is configured to contact the rear ends 9*b* of the sheets 9 on the second inclined tray 40. The regulation portion 42*b* faces the second inclined tray 40 across a sheet entry space S2 in which the rear ends 9*b* of the sheets 9 enter.

The control unit 8 controls: motors that drive various roller pairs; the path switching mechanisms 12 and 55; the staple device 3; the motor 220 that drives the alignment rotator 22; the first motor 43*c*; the second motor 44*c*; the blade moving mechanism 52 and the like.

A portion of the control unit 8 that controls the motor 220 is a part of the configuration element of the first sheet aligning device 2. In addition, a portion of the control unit 8 that controls the first motor 43*c* and the second motor 44*c* is a part of the configuration element of the second sheet aligning device 4.

Figure 2:
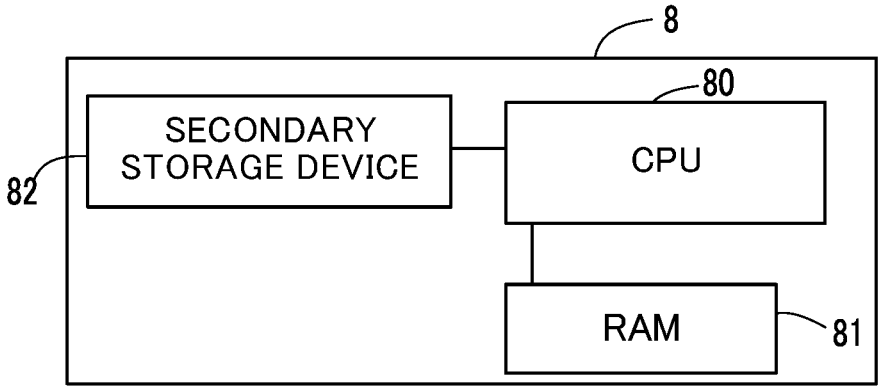
FIG. 2 is a block diagram showing a configuration of a control unit of the sheet processing device according to the first embodiment.

As shown in FIG. 2, the control unit 8 includes a CPU (Central Processing Unit) 80, a RAM (Random Access Memory) 81, and a secondary storage device 82.

The CPU 80 executes programs that are stored in the secondary storage device 82 in advance. This allows the control unit 8 to execute data processing based on detection results of various sensors, and execute various controls.

The RAM 81 is a computer-readable volatile storage device that primarily stores: the programs executed by the CPU 80; and data that is output and consulted by the CPU 80 during execution of the programs.

The secondary storage device 82 is a computer-readable nonvolatile storage device. The secondary storage device 82 stores the programs and various types of data. For example, either or both of a flash memory and a hard disk drive may be adopted as the secondary storage device 82.

For example, when the sheets 9 are conveyed onto the first inclined tray 20 of the first sheet aligning device 2, the control unit 8 rotates a motor that drives the alignment rotator 22.

In addition, when the sheet folding device 5 applies folding to the sheets 9, the control unit 8 sets a target position on the sheets 9 present on the inclined tray, based on the number of folds to be made on the sheets 9, and the size of the sheets 9.

Furthermore, before the sheets 9 are conveyed onto the second inclined tray 40 of the second sheet aligning device 4, the control unit 8 moves the second support member 41 to a lower reference position P00 corresponding to the target position by controlling the first motor 43*c* of the support member moving mechanism 43.

That is, the control unit 8 moves the second support member 41 to one lower reference position P00 that corresponds to the size of the sheets 9 on the second inclined tray 40, among a plurality of lower reference positions P00 corresponding to a plurality of sheet sizes.

Furthermore, each time a sheet 9 is conveyed onto the second inclined tray 40, the control unit 8 moves the upper alignment member 42 from a predetermined upper reference position P10 to an upper retreated position P11 that is diagonally upward of the upper reference position P10, and then to the upper reference position P10, by controlling the second motor 44*c* of the upper alignment member moving mechanism 44.

When the upper alignment member 42 moves from the upper retreated position P11 to the upper reference position P10, the rear ends 9*b* of the sheets 9 enter the sheet entry space S2 of the upper alignment member 42, and the upper alignment member 42 applies a diagonally downward force to the sheets 9.

Meanwhile, a sheet 9 with an image formed thereon may be curled and conveyed onto the second inclined tray 40 in the state of being curled. To deal with this, the second support member 41 may have a recess into which the leading end 9*a* of the sheet 9 enters.

However, if an opening of the recess of the second support member 41 is narrow, the leading end 9*a* of the sheet 9 may come off the recess of the second support member 41. If the leading end 9*a* of the sheet 9 comes off the recess of the second support member 41, the alignment performance of the sheets 9 is degraded.

On the other hand, when the opening of the recess of the second support member 41 is wide, the leading ends 9*a* of the plurality of sheets 9 may not be aligned due to varied curls of the sheets 9, and the alignment performance of the sheets 9 may be degraded.

Furthermore, when a diagonally downward force is applied to the sheets 9 on the second inclined tray 40, a portion close to the leading end 9*a* of the curled sheet 9 may bend in the recess of the second support member 41.

The second sheet aligning device 4 of the sheet processing device 1000 includes a regulation member 45 and a regulation member moving mechanism 6 that are described below. With this configuration, it is possible for the second sheet aligning device 4 to prevent degradation of the alignment performance of the sheets 9 conveyed onto the second inclined tray 40, and prevent the portion close to the leading end 9*a* of the curled sheet 9 from bending.

Regulation Member 45 and Regulation Member Moving Mechanism 6

Figure 4:
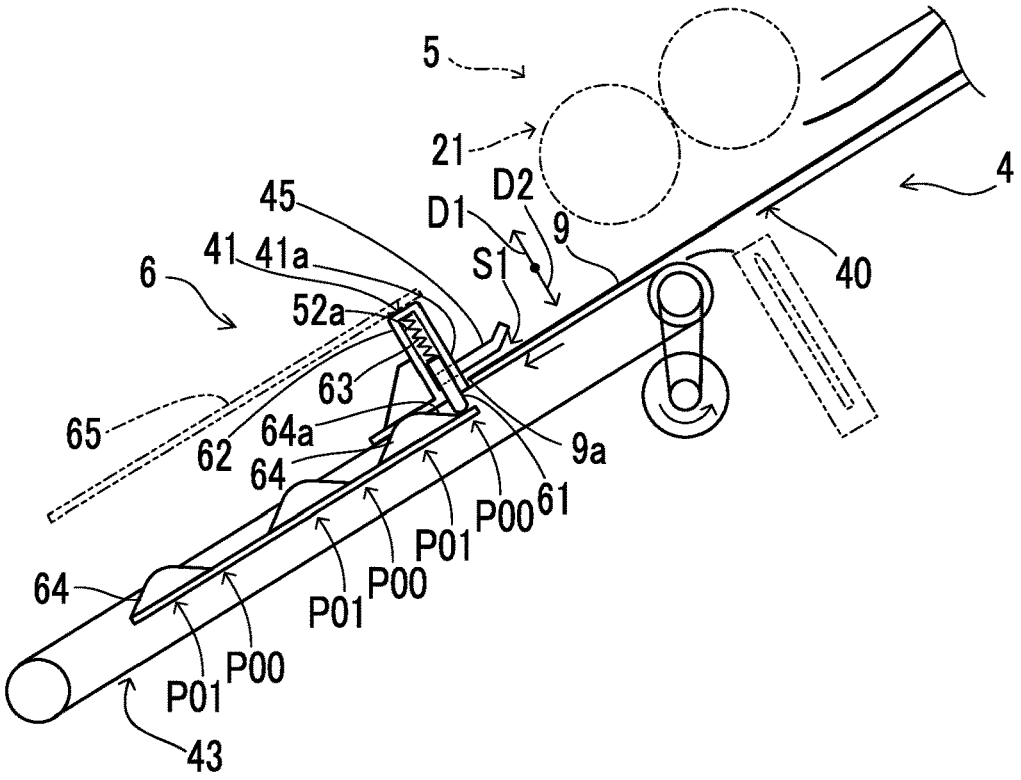
FIG. 4 is a configuration diagram of a support member moving mechanism and a regulation member moving mechanism in a reference state in the second sheet aligning device included in the sheet processing device according to the first embodiment.
Figure 5:
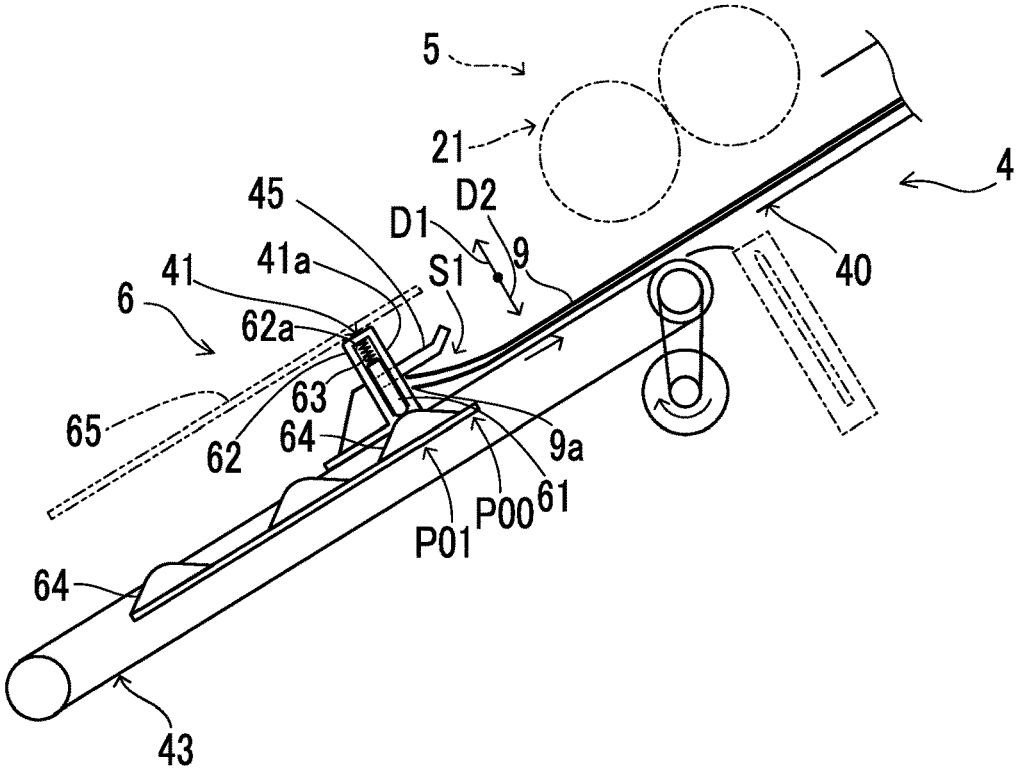
FIG. 5 is a configuration diagram of the support member moving mechanism and the regulation member moving mechanism in a retreated state in the second sheet aligning device included in the sheet processing device according to the first embodiment.
Figure 6:
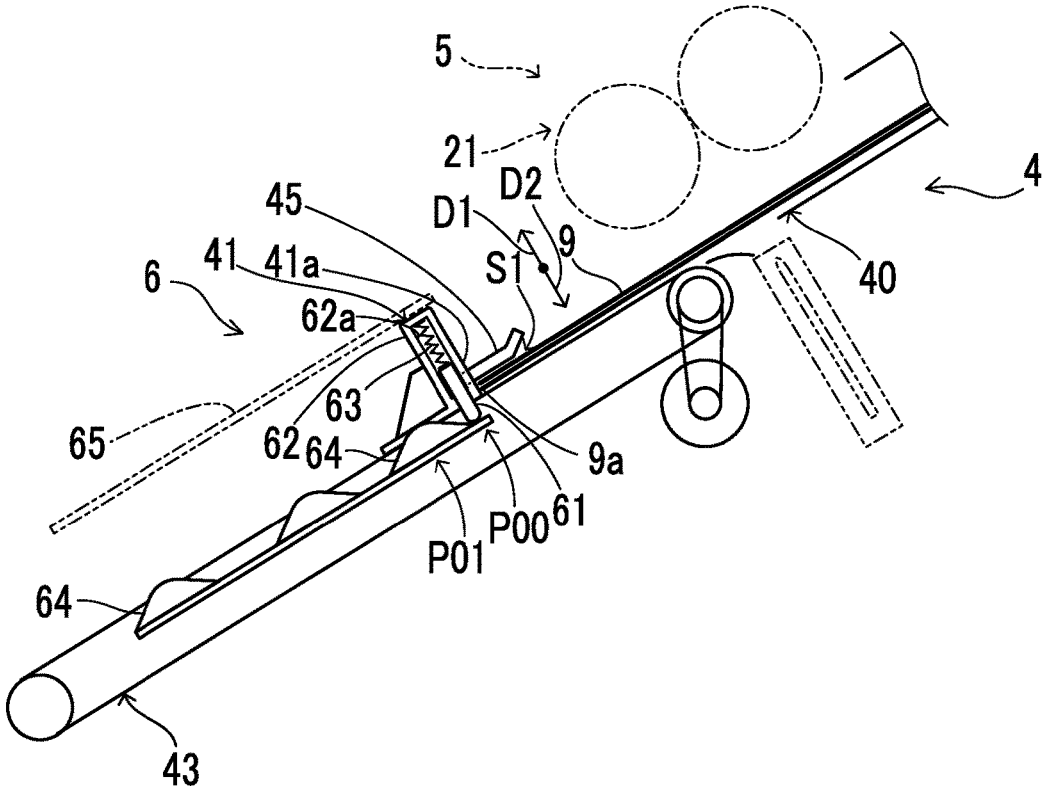
FIG. 6 is a configuration diagram of the support member moving mechanism and the regulation member moving mechanism that have returned from the retreated state to the reference state, in the second sheet aligning device included in the sheet processing device according to the first embodiment.

As shown in FIG. 4 to FIG. 6, the regulation member 45 is connected to the second support member 41. The regulation member 45 is projected from the support surface 41*a* of the second support member 41 toward the upstream in a sheet entry direction in which the sheets 9 enter onto the second inclined tray 40. The regulation member 45 is provided to face the second inclined tray 40 across a sheet entry space S1 in which the leading ends 9*a* of the sheets 9 enter. That is, the regulation member 45 faces the second inclined tray 40 in such a way as to define the sheet entry space S1. The regulation member 45 is supported so as to be movable in a separating direction from the second inclined tray 40.

Each time a sheet 9 is conveyed onto the second inclined tray 40, the regulation member moving mechanism 6 moves the regulation member 45 in a separating direction D1 to widen the sheet entry space S1, and then in an approaching direction D2 to narrow the sheet entry space S1.

In the present embodiment, the control unit 8 causes the second support member 41 to operate as follows by controlling the support member moving mechanism 43. That is, each time a sheet 9 is conveyed onto the second inclined tray 40, the control unit 8 causes the second support member 41 to be held at the lower reference position P00 to receive the sheet 9, moves the second support member 41 from the lower reference position P00 to a lower retreated position P01 that is diagonally downward of the lower reference position P00, and then to the lower reference position P00.

The regulation member moving mechanism 6 moves the regulation member 45 in conjunction with the movement of the second support member 41. That is, the regulation member moving mechanism 6 moves the regulation member 45 in the separating direction D1 in conjunction with the movement of the second support member 41 from the lower reference position P00 to the lower retreated position P01. Furthermore, the regulation member moving mechanism 6 moves the regulation member 45 in the approaching direction D2 in conjunction with the movement of the second support member 41 from the lower retreated position P01 to the lower reference position P00.

As described above, each time a sheet 9 is conveyed onto the second inclined tray 40, the regulation member moving mechanism 6 widens the sheet entry space S1 by moving the regulation member 45 in the separating direction from the second inclined tray 40. Thereafter, the regulation member moving mechanism 6 narrows the sheet entry space S1 by moving the regulation member 45 in an approaching direction to the second inclined tray 40. The following describes a specific configuration of the regulation member moving mechanism 6 according to the present embodiment.

The regulation member moving mechanism 6 includes a guided portion 61, a guiding portion 62, a spring 63, and one or more contact members 64. In the present embodiment, the regulation member moving mechanism 6 includes a plurality of contact members 64 that are respectively disposed at a plurality of lower retreated positions P01 that respectively correspond to a plurality of lower reference positions P00.

The guided portion 61 is integrally formed with the regulation member 45. The guiding portion 62 is formed in the second support member 41. The guiding portion 62 guides the guided portion 61 in the separating direction D1 so that the regulation member 45 is separated from the second inclined tray 40, and in the approaching direction that is reverse to the separating direction D1.

In the example shown in FIG. 4, the guiding portion 62 has a long hole 62*a* in which the guided portion 61 is fitted. The long hole 62*a* is formed to extend in the separating direction D1.

The spring 63 applies an elastic force in the approaching direction D2 to the guided portion 61. It is noted that the spring 63 is an example of an elastic member. The spring 63 may be replaced with another elastic member such as rubber.

The contact members 64 are held by the frame 7 at predetermined positions and formed to project in the separating direction D1. The contact members 64 include contact surfaces 64*a* that are inclined with respect to a direction extending along the second inclined tray 40. When the second support member 41 moves from the lower reference position P00 to the lower retreated position P01, the guided portion 61 slides on the contact surfaces 64*a*.

FIG. 4 shows a state where the second support member 41 is present at the lower reference position P00, and the regulation member 45 is present at a predetermined proximity position. When the regulation member 45 is present at the proximity position, the sheet entry space S1 is the narrowest.

When the second support member 41 moves from the lower reference position P00 to the lower retreated position P01, the regulation member 45 moves in the separating direction D1 from the proximity position by a pressure applied from the contact surface 64*a* to the guided portion 61.

FIG. 5 shows a state where the second support member 41 is present at the lower retreated position P01, and the regulation member 45 is present at a position farther from the second inclined tray 40 than the proximity position and farthest from the second inclined tray 40. In this state, the sheet entry space S1 is the widest.

Furthermore, when the second support member 41 moves from the lower retreated position P01 to the lower reference position P00, the regulation member 45 moves in the approaching direction D2 by the elastic force of the spring 63 and returns to the proximity position. FIG. 6 shows a state where the second support member 41 has returned to the lower reference position P00, and the regulation member 45 has returned to the proximity position.

The spring 63 and the contact member 64, in conjunction with the movement of the second support member 41 from the lower reference position P00 to the lower retreated position P01, move the guided portion 61 in the separating direction D1. Furthermore, the spring 63 and the contact member 64, in conjunction with the movement of the second support member 41 from the lower retreated position P01 to the lower reference position P00, move the guided portion 61 in the approaching direction D2.

In the second sheet aligning device 4, the spring 63 and the contact members 64 are an example of an interlocking mechanism configured to move the guided portion 61 in conjunction with a movement of the second support member 41.

The control unit 8 causes the support member moving mechanism 43 to move the second support member 41 from the lower retreated position P01 to the lower reference position P00. This causes the upper alignment member moving mechanism 44 to move the upper alignment member 42 from the upper retreated position P11 to the upper reference position P10 each time the leading end 9*a* of a sheet 9 is supported by the second support member 41.

The control unit 8 may cause the support member moving mechanism 43 to move the second support member 41 from the lower retreated position P01 to the lower reference position P00, and thereafter, may cause the upper alignment member moving mechanism 44 to move the upper alignment member 42 from the upper retreated position P11 to the upper reference position P10.

When the second sheet aligning device 4 is to receive a sheet 9 on the second inclined tray 40, the second sheet aligning device 4 widens the sheet entry space S1. This prevents the leading end 9*a* of the sheet 9 from coming off the sheet entry space S1 that is formed by the second support member 41 and the regulation member 45.

Furthermore, after the sheet 9 has been received on the second inclined tray 40, the second sheet aligning device 4 narrows the sheet entry space S1. This prevents the leading ends 9*a* of a plurality of sheets 9 from not being aligned due to varied curls of the sheets 9.

Similarly, the above-described configuration prevents a portion close to the leading end 9*a* of the curled sheet 9 from bending in the sheet entry space S1 when the upper alignment member 42 applies a diagonally downward force to the sheets 9 on the second inclined tray 40. With this configuration, even if the sheets 9 are curled, the upper alignment member 42 aligns the rear ends 9*b* of the sheets 9 while the leading ends 9*a* of the sheets 9 abut on the second support member 41.

Accordingly, it is possible to prevent the alignment performance of the sheets 9 conveyed onto the second inclined tray 40 from being degraded due to curls of the sheets 9.

Second Embodiment

Figure 7:
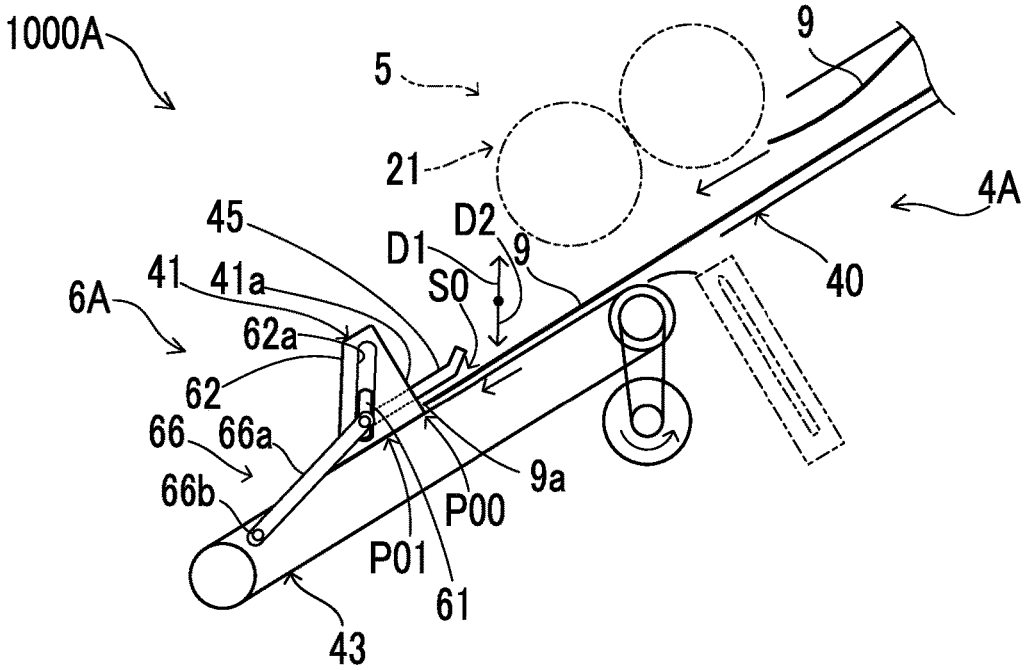
FIG. 7 is a configuration diagram of a support member moving mechanism and a regulation member moving mechanism in the reference state in a second sheet aligning device included in a sheet processing device according to a second embodiment.
Figure 8:
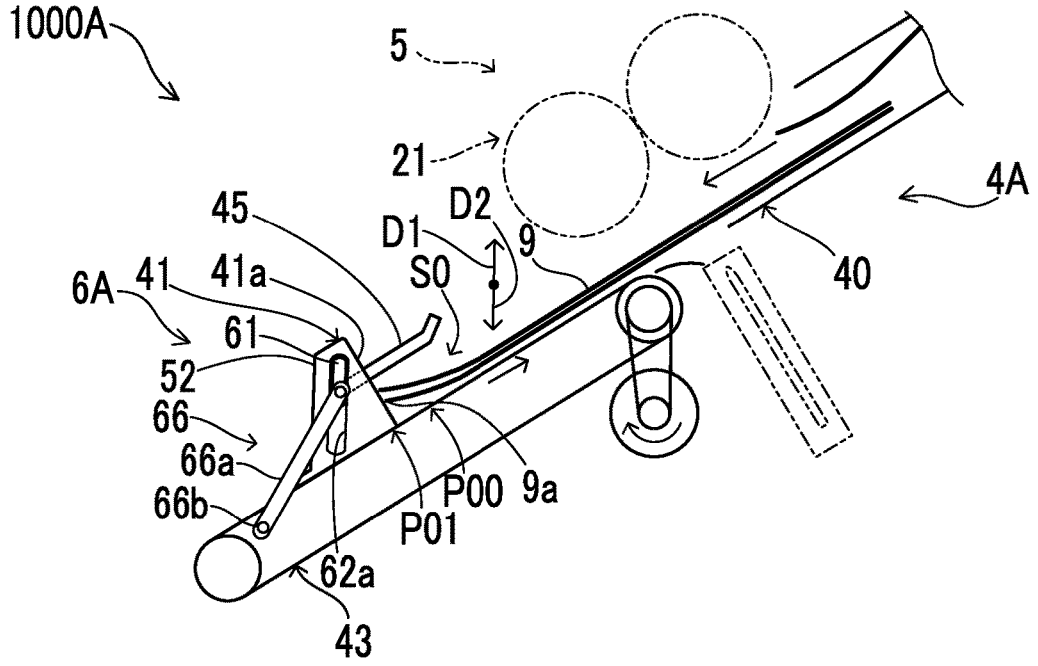
FIG. 8 is a configuration diagram of the support member moving mechanism and the regulation member moving mechanism in the retreated state in the second sheet aligning device included in the sheet processing device according to the second embodiment.

The following describes, with reference to FIG. 7 and FIG. 8, a second sheet aligning device 4A included in a sheet processing device 1000A according to a second embodiment of the present disclosure. The second sheet aligning device 4A is an application example of the second sheet aligning device 4.

In FIG. 7 and FIG. 8, the same components as those shown in FIG. 1 to FIG. 6 are assigned the same reference signs. The sheet processing device 1000A has a configuration where the second sheet aligning device 4 in the sheet processing device 1000 has been replaced with the second sheet aligning device 4A.

In addition, the second sheet aligning device 4A has a configuration where the regulation member moving mechanism 6 in the second sheet aligning device 4 has been replaced with a regulation member moving mechanism 6A.

The following describes differences of the regulation member moving mechanism 6A from the regulation member moving mechanism 6. The regulation member moving mechanism 6A, as is the case with the regulation member moving mechanism 6, includes the guided portion 61 and the guiding portion 62.

The regulation member moving mechanism 6A includes a link mechanism 66 that includes the guided portion 61 and a link member 66*a*. The link member 66*a* is connected to a fixed portion 66*b* in such a way as to pivot around the fixed portion 66*b* that is held by the frame 7 at a predetermined position.

The link mechanism 66 moves the guided portion 61 in the separating direction D1 in conjunction with the movement of the second support member 41 from the lower reference position P00 to the lower retreated position P01. Furthermore, the link mechanism 66 moves the guided portion 61 in the approaching direction D2 in conjunction with the movement of the second support member 41 from the lower retreated position P01 to the lower reference position P00.

FIG. 7 shows a state where the second support member 41 is present at the lower reference position P00, and the regulation member 45 is present at the proximity position. When the regulation member 45 is present at the proximity position, the sheet entry space S1 is the narrowest.

FIG. 8 shows a state where the second support member 41 is present at the lower retreated position P01, and the regulation member 45 is present at a position farther from the second inclined tray 40 than the proximity position and farthest from the second inclined tray 40. In this state, the sheet entry space S1 is the widest.

In the second sheet aligning device 4A, the link mechanism 66 is an example of the interlocking mechanism configured to move the guided portion 61 in conjunction with a movement of the second support member 41.

It is noted that in the sheet processing device 1000A, the sheet folding device 5 is configured to perform only either of the two-fold working or the three-fold working on the plurality of sheets 9 aligned by the second sheet aligning device 4A. In addition, in the second sheet aligning device 4A, the lower reference position P00 is a predetermined one position.

The second sheet aligning device 4A produces the same effect as the second sheet aligning device 4.

Third Embodiment

Figure 9:
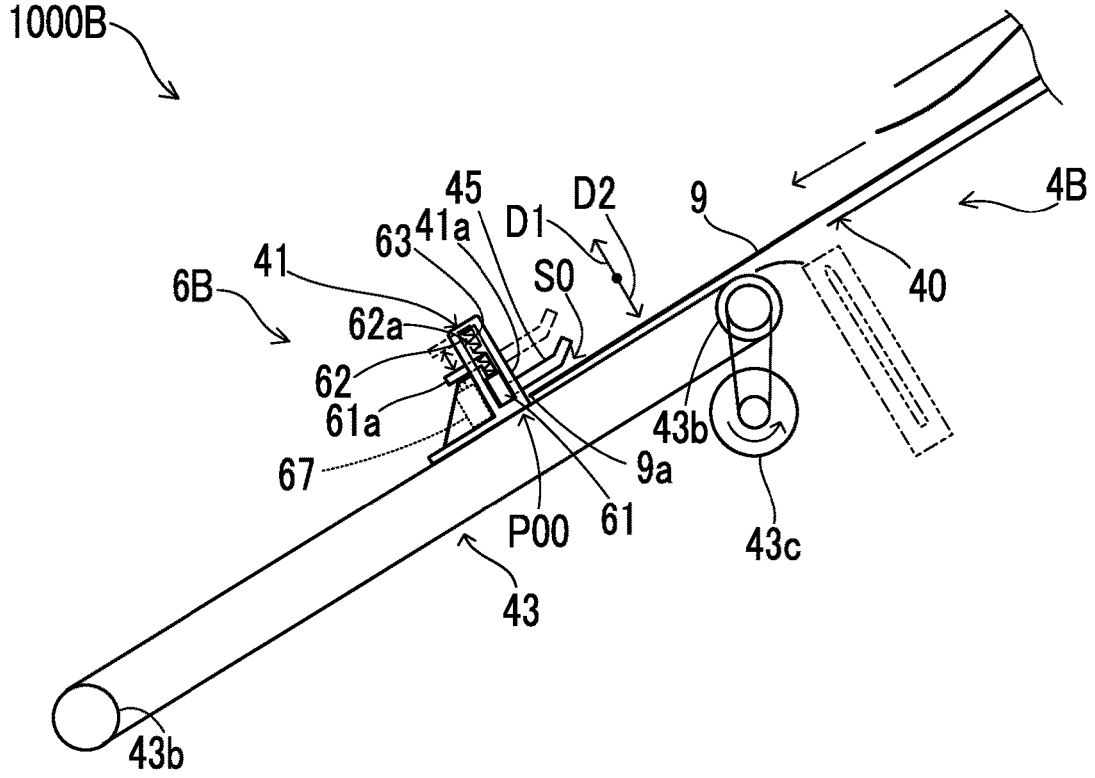
FIG. 9 is a configuration diagram of a support member moving mechanism and a regulation member moving mechanism in a second sheet aligning device included in a sheet processing device according to a third embodiment.

The following describes, with reference to FIG. 9, a second sheet aligning device 4B included in a sheet processing device 1000B according to a third embodiment of the present disclosure. The second sheet aligning device 4B is an application example of the second sheet aligning device 4.

In FIG. 9, the same components as those shown in FIG. 1 to FIG. 6 are assigned the same reference signs. The sheet processing device 1000B has a configuration where the second sheet aligning device 4 in the sheet processing device 1000 has been replaced with the second sheet aligning device 4B.

In addition, the second sheet aligning device 4B has a configuration where the regulation member moving mechanism 6 in the second sheet aligning device 4 has been replaced with a regulation member moving mechanism 6B.

The following describes differences of the regulation member moving mechanism 6B from the regulation member moving mechanism 6. The regulation member moving mechanism 6B, as is the case with the regulation member moving mechanism 6, includes the guided portion 61, the guiding portion 62, and the spring 63.

The regulation member moving mechanism 6B includes an actuator 67 in place of the contact members 64. The actuator 67, in response to a control command from the control unit 8, switches between: a state where it supports the regulation member 45 at the proximity position; and a state where it supports the regulation member 45 at a position farther from the second inclined tray 40 than the proximity position.

In the present embodiment, a moving portion of the actuator 67 abuts on, in the separating direction D1, a supported portion 61*a* that is a part of the guided portion 61. For example, the actuator 67 is a solenoid. It is noted that the actuator 67 may be realized by a motor and a cam mechanism.

The actuator 67 allows the regulation member 45 to be present at the proximity position by supporting the supported portion 61*a* at a first position against the elastic force of the spring 63. In FIG. 9, the supported portion 61*a* supported at the first position and the regulation member 45 present at the proximity position are represented by a solid line.

In addition, the actuator 67 allows the regulation member 45 to be present at a position farther from the second inclined tray 40 than the proximity position in the separating direction D1, by supporting the supported portion 61*a* at a second position against the elastic force of the spring 63. In FIG. 9, the supported portion 61*a* supported at the second position and the regulation member 45 present at the position farther from the second inclined tray 40 than the proximity position in the separating direction D1 are represented by an imaginary line (two-dot chain line).

That is, the actuator 67, in response to a control command from the control unit 8, switches between: the state where it supports the regulation member 45 at the proximity position; and the state where it supports the regulation member 45 at the position farther from the second inclined tray 40 than the proximity position.

Each time a sheet 9 is conveyed onto the second inclined tray 40, the control unit 8, by controlling the actuator 67, moves the supported portion 61*a* from the first position to the second position, and then returns the supported portion 61*a* to the first position.

Accordingly, each time a sheet 9 is conveyed onto the second inclined tray 40, the regulation member 45 moves in the separating direction D1 from the proximity position, and then returns to the proximity position. As such, in the present embodiment, it is not necessary to move the second support member 41 from the lower reference position P00 to the lower retreated position P01 each time a sheet 9 is conveyed onto the second inclined tray 40.

The second sheet aligning device 4B produces the same effect as the second sheet aligning device 4.

Fourth Embodiment

Figure 10:
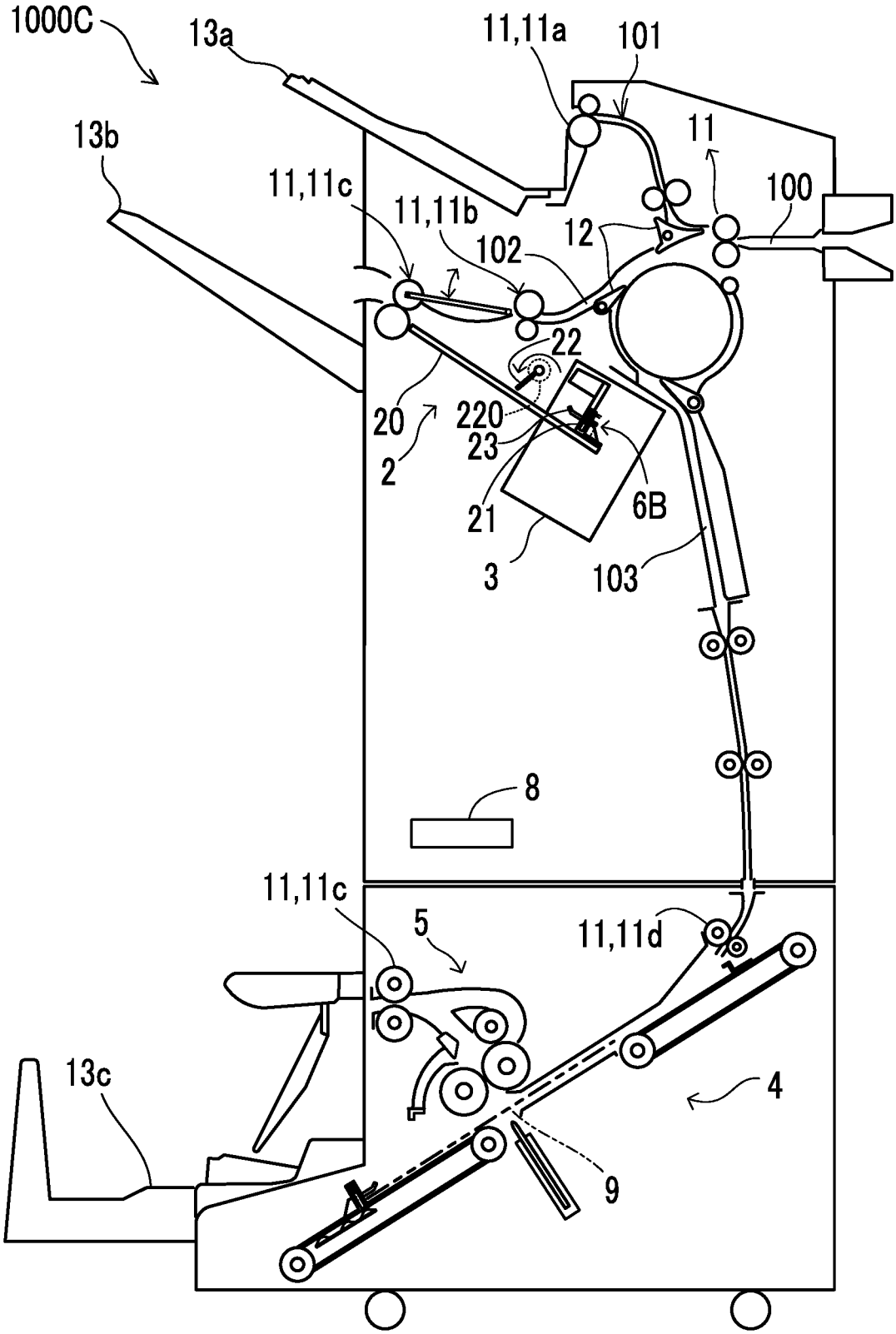
FIG. 10 is a configuration diagram of a sheet processing device according to a fourth embodiment.

The following describes, with reference to FIG. 10, a sheet processing device 1000C according to a fourth embodiment of the present disclosure.

The sheet processing device 1000C has a configuration where a regulation member moving mechanism 6B has been added to the sheet processing device 1000. In the present embodiment, the regulation member moving mechanism 6B is configured to move a regulation member 23 connected to the first support member 21 of the first sheet aligning device 2.

When the sheet processing device 1000C is adopted, the first sheet aligning device 2 produces the same effect as the second sheet aligning device 4.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet aligning device that has an inclined tray held by a frame and aligns a plurality of sheets conveyed onto the inclined tray, the sheet aligning device comprising:

a support member projected on the inclined tray, supported so as to be movable on the inclined tray, having a support surface that abuts on leading ends of the sheets that are sequentially conveyed onto the inclined tray, the support member configured to support, at a predetermined reference position, the leading ends of the sheets;

a support member moving mechanism configured to move the support member along the inclined tray;

a regulation member, projected from the support surface toward an upstream in a sheet entry direction in which the sheets enter onto the inclined tray, supported so as to be movable on the support surface in a separating direction from or an approaching direction to the inclined tray, and defining a sheet entry space in which the leading ends of the sheets enter;

a regulation member moving mechanism configured to move the regulation member on the support surface; and a control unit configured to control the support member moving mechanism and the regulation member moving mechanism, the control unit controlling the regulation member moving mechanism each time a sheet is conveyed onto the inclined tray, to widen the sheet entry space by moving the regulation member in the separating direction from the inclined tray, and then to narrow the sheet entry space by moving the regulation member in the approaching direction to the inclined tray.

2. The sheet aligning device according to claim 1, wherein each time a sheet is conveyed onto the inclined tray, the control unit controls the support member moving mechanism to cause the support member to be held at the reference position to receive the sheet, and move the support member from the reference position to a retreated position that is diagonally downward of the reference position, and then return to the reference position, and the regulation member moving mechanism includes:

a guided portion formed with the regulation member:

a guiding portion formed in the support member and configured to guide the guided portion in the separating direction, or in the approaching direction; and an interlocking mechanism configured to move the guided portion in the separating direction in conjunction with a movement of the support member from the reference position to the retreated position, and move the guided portion in the approaching direction in conjunction with a movement of the support member from the retreated position to the reference position.

3. The sheet aligning device according to claim 2, wherein the interlocking mechanism is a link mechanism that includes the guided portion and a link member, and one edge portion of the link member is connected to a fixed portion provided in the frame and another edge portion of the link member is connected to the guided portion so that the link member can pivot around the one edge portion.

4. The sheet aligning device according to claim 2, wherein the interlocking mechanism includes:

an elastic member configured to apply an elastic force in the approaching direction to the guided portion; and a contact member provided in the frame at the retreated position and formed to project in the separating direction, the contact member including a contact surface that is inclined with respect to a moving direction of the support member, wherein when the support member moves from the reference position to the retreated position, the guided portion slides on the contact surface, when the support member moves from the reference position to the retreated position, the regulation member moves in the separating direction from a predetermined proximity position by a pressure applied from the contact surface to the guided portion, and when the support member moves from the retreated position to the reference position, the regulation member moves in the approaching direction by the elastic force of the elastic member and returns to the proximity position.

5. The sheet aligning device according to claim 4, wherein before the sheets are conveyed onto the inclined tray, the control unit controls the support member moving mechanism to move the support member to one reference position that corresponds to a size of the sheets, among a plurality of reference positions corresponding to a plurality of sheet sizes, and the interlocking mechanism includes a plurality of contact members that include the contact member and are respectively disposed at a plurality of retreated positions that include the retreated position and respectively correspond to a plurality of reference positions that include the reference position.

6. The sheet aligning device according to claim 1, wherein the regulation member moving mechanism includes an actuator configured to switch between: a state where the actuator supports the regulation member at a predetermined proximity position; and a state where the actuator supports the regulation member at a separation position farther from the inclined tray than the proximity position.

7. The sheet aligning device according to claim 1, further comprising:

an alignment member disposed to face the support member on the upstream of the support member in the sheet entry direction, supported so as to be movable along the inclined tray, the alignment member configured to align the sheets on the inclined tray whose leading ends are supported by the support member, by abutting on rear ends of the sheets.

8. A sheet processing device comprising:

the sheet aligning device according to claim 1 configured to align a plurality of sheets with images formed thereon supplied from an image forming apparatus; and a sheet working device configured to apply a predetermined working to the plurality of sheets aligned by the sheet aligning device.

9. An image processing apparatus comprising:

an image forming apparatus configured to form an image on a sheet; and the sheet processing device according to claim 8.

* * * * *